United States Patent [19]

Kaiser et al.

[11] 4,146,469

[45] Mar. 27, 1979

[54] MOUNTING OF CLEANERS IN PAPERMAKING SYSTEM

[75] Inventors: Robert G. Kaiser, Seminole, Fla.; Jack J. J. Jacobsson, London, England

[73] Assignee: Clark & Vicario Corporation, St. Petersburg, Fla.

[21] Appl. No.: 840,999

[22] Filed: Oct. 11, 1977

[51] Int. Cl.[2] ..... B04C 5/28

[52] U.S. Cl. ..... 209/211; 210/512 M

[58] Field of Search ..... 209/211, 144; 55/41, 55/346–349; 210/512 M, 512 R

[56] References Cited

U.S. PATENT DOCUMENTS

| | | | |
|---|---|---|---|
| 2,765,918 | 10/1956 | Fontein et al. | 209/211 X |
| 3,061,994 | 11/1962 | Mylting | 55/346 |
| 3,335,860 | 8/1967 | Baxter | 209/211 |
| 3,371,794 | 3/1968 | Johnson | 209/211 X |
| 3,538,680 | 11/1970 | Kaiser | 55/41 |
| 3,543,931 | 12/1970 | Rastatter | 209/211 |
| 3,862,041 | 1/1975 | Robinson | 209/211 X |
| 3,940,331 | 2/1976 | Rastatter | 209/211 |
| 3,959,123 | 5/1976 | Wikdahl | 209/211 |
| 3,959,150 | 5/1976 | Frykhult et al. | 209/211 X |

FOREIGN PATENT DOCUMENTS

| | | | |
|---|---|---|---|
| 2150737 | 4/1973 | Fed. Rep. of Germany | 55/349 |

*Primary Examiner*—Ralph J. Hill

*Attorney, Agent, or Firm*—Watson, Leavenworth, Kelton & Taggart

[57] ABSTRACT

More efficient and effective mounting of centrifugal cleaners in a cleaning stage of papermaking apparatus is effected by mounting the cleaners in vertical orientation in a feed plenum in which the inlets to the cleaners are disposed submerged in the papermaking suspension flow in the plenum, the feed plenum being disposed at the underside of a receiver maintained under vacuum to which the accepts from the cleaners discharge, the rejects from the cleaners also discharging to a chamber maintained under vacuum. Additionally, means are provided for readily, removably mounting the cleaners to the plenum structure.

20 Claims, 21 Drawing Figures

MOUNTING OF CLEANERS IN PAPERMAKING SYSTEM

BACKGROUND OF THE INVENTION

The present invention relates to apparatus for treating a suspension of papermaking stock and more particularly relates to apparatus for cleaning and deaerating a papermaking suspension to provide a papermaking stock supply for a papermaking machine.

In the papermaking art, it long has been known advantageous to deaerate the aqeuous suspension of papermaking fiber prior to its delivery to the papermaking machine. Patents which disclose apparatus for such procedure include, inter alia, U.S. Pat. Nos. 1,853,849; 2,571,219; 2,614,656; 2,685,937; 2,642,950; 2,751,031; 3,131,117; 3,432,036; 3,538,680; and 3,720,315. As such patents teach, it is also commonplace to effect cleaning of the stock to separate it into a dirt-rich fraction, commonly known as a "rejects" fraction and a dirt-poor fraction, known as an "accepts" fraction, such separation being effected in a centrifugal suspended solids separating means commonly referred to as a hydrocyclone. The construction and operation of such cleaning device is described, for example, in U.S. Pat. No. 2,377,524.

Where cleaning of the stock is effected, it also is commonplace to employ plural cleaning stages, that is, a first or primary cleaning stage the accepts from which provides the stock feed to the papermaking machine, a secondary cleaning stage the accepts fraction of which is returned to the primary stage for further cleaning and a tertiary stage in which the accepts are or may be returned to the second stage for further cleaning. Additional stages in the system can be cleaned in like manner.

Each cleaning stage generally comprises a plurality of centrifugal cleaners the number in the primary stage being considerably more than the secondary stage and the secondary stage more than the tertiary stage. In modern papermaking plants, hundreds of cleaners can be used in the cleaning and deaeration operations. The practice heretofore has been to supply stock suspension to the cleaners through a manifold to which each individual cleaner is connected by means of piping, flange connections, etc. Where a large number of cleaners are employed in the cleaning stage, as for example in the primary cleaning stage, the use of individual connections to each of the respective cleaners requires that considerable power be expended to overcome frictional and flow losses occurring in the supply and connection structure associated with the cleaners. Moreover, the initial installation costs of mounting a large number of cleaners in a cleaning stage to a manifold and connecting same to an enclosed receiver to which the accepts fractions are delivered is considerable. Furthermore, during operation, it is possible for a cleaner to become unserviceable, i.e., become worn so that its cleaning efficiency is impaired to the extent that it requires replacement. The manner of mounting cleaners heretofore employed has not made it convenient to quickly and readily remove cleaners and replace same with facility.

Employment in papermaking systems of cleaners having plural inlets thereto and which further are submerged in a stock suspension flow are known, U.S. Pat. Nos. 3,747,306; 3,261,467; 3,415,374; 3,486,618 and 3,959,123 disclosing such arrangements. However, in such systems as disclosed in said patents, the cleaners are arranged with their axes disposed horizontally and the cleaners arrayed in horizontal and/or radial array. Thus the placement of the cleaners does not involve taking advantage of the effect of gravity in connection with rejects discharge and hence higher power consumption attends cleaner operation. Moreover, such cleaner arrangements do not use discharge of either accepts or rejects to a condition of vacuum and again and since such discharges are to a submerged flow, higher power consumption is required than is necessary. Since energy costs are constantly increasing it is desirable that the cleaning operation in a papermaking system be made as efficient as possible.

These problems and undesirable features of centrifugal cleaner mountings are solved or lessened by the present invention as will be apparent from the description which follows.

SUMMARY OF THE INVENTION

In accordance with the present invention, the centrifugal cleaners of a cleaning stage are readily removably mounted in a feed plenum with the inlets to each cleaner disposed within the plenum and submerged in the suspension flow in the plenum. Desirably, the plenum is mounted directly below an enclosed stock receiver maintained under a deaerating condition of vacuum to which the dirt-poor accepts fraction issuing from the cleaner are discharged through inlet pipes into the enclosed receiver. Furthermore, the cleaners are oriented parallel one with the others and with the upper body parts thereof in substantially vertical or "natural attitude" disposition so that the dirt-rich and dirt-poor outlets are at the respective lower and upper ends of the cleaner body, the rejects also outletting to a condition of vacuum. In such manner, most efficient utilization of the cleaners is effected in that the effects of gravity and vacuum are employed to reduce cleaning stage power consumption. Further, the need for multiplicity of individual connections between a feed manifold and the respective cleaners as heretofore practiced is eliminated and therefore the cleaners conveniently and readily can be mounted in the plenum or removed as the case may be for repair, servicing and the like. Also, further lessening of power consumption requirement attends such mounting of the cleaners in a common feed plenum since flow losses are substantially reduced.

To maintain a constant velocity of feed suspension flow in the plenum, the cross-sectional area of the plenum can diminish from the point of introduction of suspension to the plenum in the direction of flow, such diminishing cross-sectional area compensating for such conditions in the plenum as tend to reduce the velocity of flow. The plenum can be provided in various forms and is disposed below the enclosed receiver to which the cleaned accepts portion of a stock is delivered. The plenum generally will extend a substantial distance along the length of the receiver and can be formed as a separate enclosed structure connected to the underside of the receiver or it could be formed by structure which employs the underside of the enclosed receiver itself as part of the means defining the plenum enclosure. The cross-sectional area can diminish at a uniformly decreasing rate or the plenum can be made such that its cross-sectional area decreases in stepped reduction along successive lengths thereof.

As has been noted, an important feature of the present invention is that the centrifugal cleaners can be readily removably mounted in the plenum in vertical or natural attitude and in a manner as involves minimal use of connecting means while at the same time air-excluding joints are easily and conveniently established at the locations where the cleaner body enters the plenum and further where the accepts pipe leading from each cleaner to the receiver passes through from the plenum into the receiver. In one form, the mounting includes a seal member which encircles the upper body part of the cleaner where it passes through an opening in the plenum lower wall part and which seal member extends a distance above and below the lower wall part. A support ring is carried on the cleaner body a distance below the openings and a bolt member is supported from the plenum lower wall adjacent the opening and passes through the support ring. A fastener member, e.g., a nut carried on the bolt member below the support ring can be used to apply upwardly directed force to the support ring and hence to urge the cleaner upwardly in the feed plenum. A further seal member is provided on top of the cleaner which is urged into contact with either the underside of the receiver or the undersurface of the plenum top structure depending on the construction of the plenum itself so as to effect a seal of the joint where the accepts pipe from the cleaner passes from the plenum into the receiver. Such top seal desirably is configured to conform with the surface of the receiver or the undersurface of the plenum top as the case may be. The support rings are designed to be compatible with the cleaner body so that in the case where the cleaner body has a tapered lower body section, the support ring can be an annular member the inner surface of which is tapered in correspondence to the cleaner body taper so that upward urging of the support ring results in transmitting the required upward force to the cleaner itself to maintain it securely mounted in the plenum. In the instance where the cleaner body may not readily lend itself to use with a support ring arrangement that could apply undue force to the cleaner body structure as the case where the cleaner is made of thermoplastic material, the cleaner body can be provided with a flange formed integral therewith and the support ring can be employed to apply upward lifting force against the flange. In the instance where the cleaner body is subjected to longitudinal expansion during the cleaning operation, compensating means in the form of a compression spring can be provided and be carried on the bolt member and be disposed intermediate the support ring and the nut member. Thus, with expansion of the cleaner, the spring will compress to take up the elongation effect of the cleaner without causing damage to the cleaner body itself.

Suitable air-excluding means can be used at the joints where the cleaner passes through the plenum lower wall part and also where the accepts pipe passes into the receiver, such means being provided for example in the form of labyrinth structure or o-rings.

The rejects end of the cleaners which are connected to a rejects chamber maintained under a deaerating condition of vacuum also can in accordance with the present invention be designed to permit ready mounting and removal of the cleaner from the cleaning stage. Desirably, the dirt-rich discharge outlet of each cleaner is connected to the manifold by an intervening tubular sight glass and an air-excluding joint is provided by means of o-rings disposed between the sight glass and the bottom tubular end of the cleaner and additionally, the employment of a flexible member which encircles the sight glass where it enters the manifold and adjacent surfaces of the manifold with the member collapsing against the sight glass and adjacent surfaces under the influence of reduced pressure in the manifold. Thus an air-excluding joint is readily and conveniently established while at the same time if it is necessary to remove the cleaner from the stage, the same can be effectively and quickly effected by merely sliding the sight glass up upon the cleaner or down upon the chamber structure, or by completely removing the sight glass.

In accordance with the invention, centrifugal cleaners having plural inlets in the side of the body thereof which are circularly spaced one from the other, can be disposed with the inlets in any desired orientation with respect to the direction of suspension flow. In accordance with the invention, orienting means comprising a locator projection which can be carried on top of the plenum and projections which are carried on the top of the cleaner are used for establishing the desired orientation. Where projections are used for this purpose, the top seal member can be provided with companion grooves in which the respective projections are received. In an alternative form, a telltale projection or indicia can be carried on the side of the cleaner at a location external of the plenum and the indicia or projection can be positioned circularly relatively of a companion telltale projection or indicia carried on the outer surface of the plenum for effecting desired rotational positioning of the inlets relative to the flow direction within the plenum itself.

A further feature of the invention provides that conduit means are connected with the plenum at a location remote from the point of introduction of the suspension to the plenum so that a flow of suspension will always pass through said conduit from the plenum to purge the plenum of any air or solids which may be present in the plenum at said location. The conduit means can discharge to any suitable subsequent point of use in the apparatus as, for example, it can discharge to a suspension cleaning device discharging to the secondary cleaning stage feed.

The invention accordingly comprises the apparatus embodying features of construction, combination of elements and arrangements of parts, all as will be exemplified in the following detailed disclosure.

DESCRIPTION OF THE DRAWINGS

For a further understanding of the nature and objects of the invention, reference should be had to the following detailed description taken in conjunction with the accompanying drawings, in which.

Throughout the description, like reference numerals are used to denote like parts in the drawings.

DESCRIPTION OF THE PREFERRED EMBODIMENTS

The present invention is concerned with improvements in papermaking systems and especially the manner and means employed in such systems for more effectively and efficiently integrating the centrifugal cleaners in such systems. It is particularly concerned with the advantages which inure from lowering initial installation costs for cleaner mounting as well as eliminating and reducing the number of connections and separate appurtenant components as were heretofore required for mounting the cleaners in a particular cleaning stage. Furthermore, the elimination of unnecessary fittings, piping and the like as well as mounting the cleaners in a natural or vertical attitude results in a considerable saving in the amount of power required to supply papermaking suspension to the cleaning operation at the requisite pressure and volumetric flow for the intended purposes.

Figure 1:
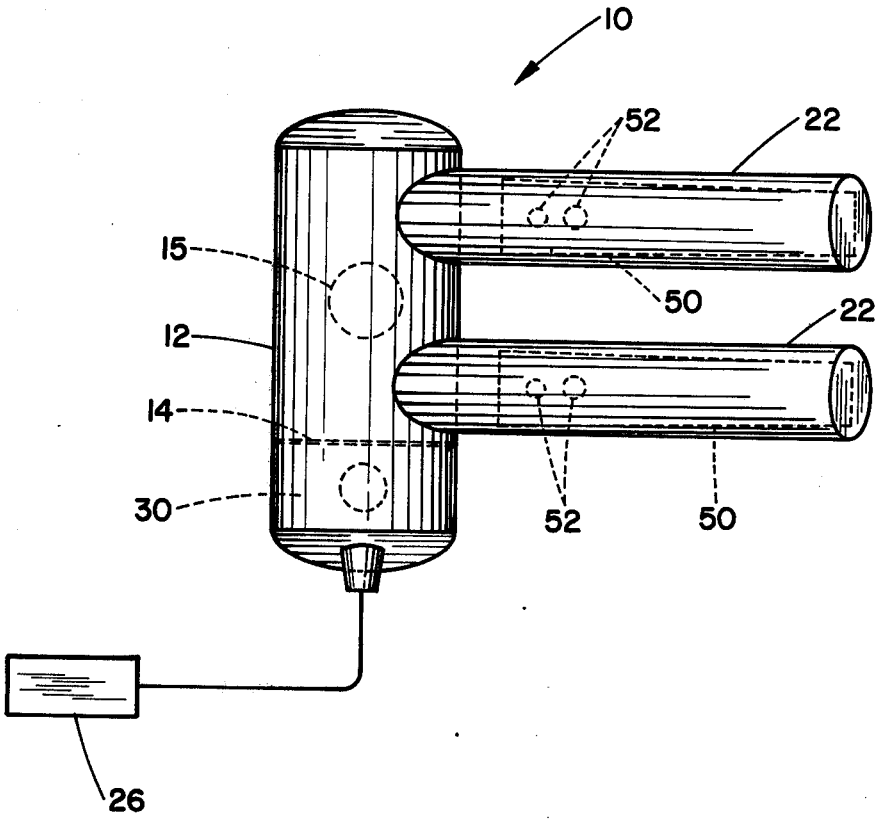
FIG. 1 is a top plan view of one form of apparatus for treating a suspension in accordance with the present invention, the cleaning stage depicted being a primary or first stage cleaning operation.
Figure 2:
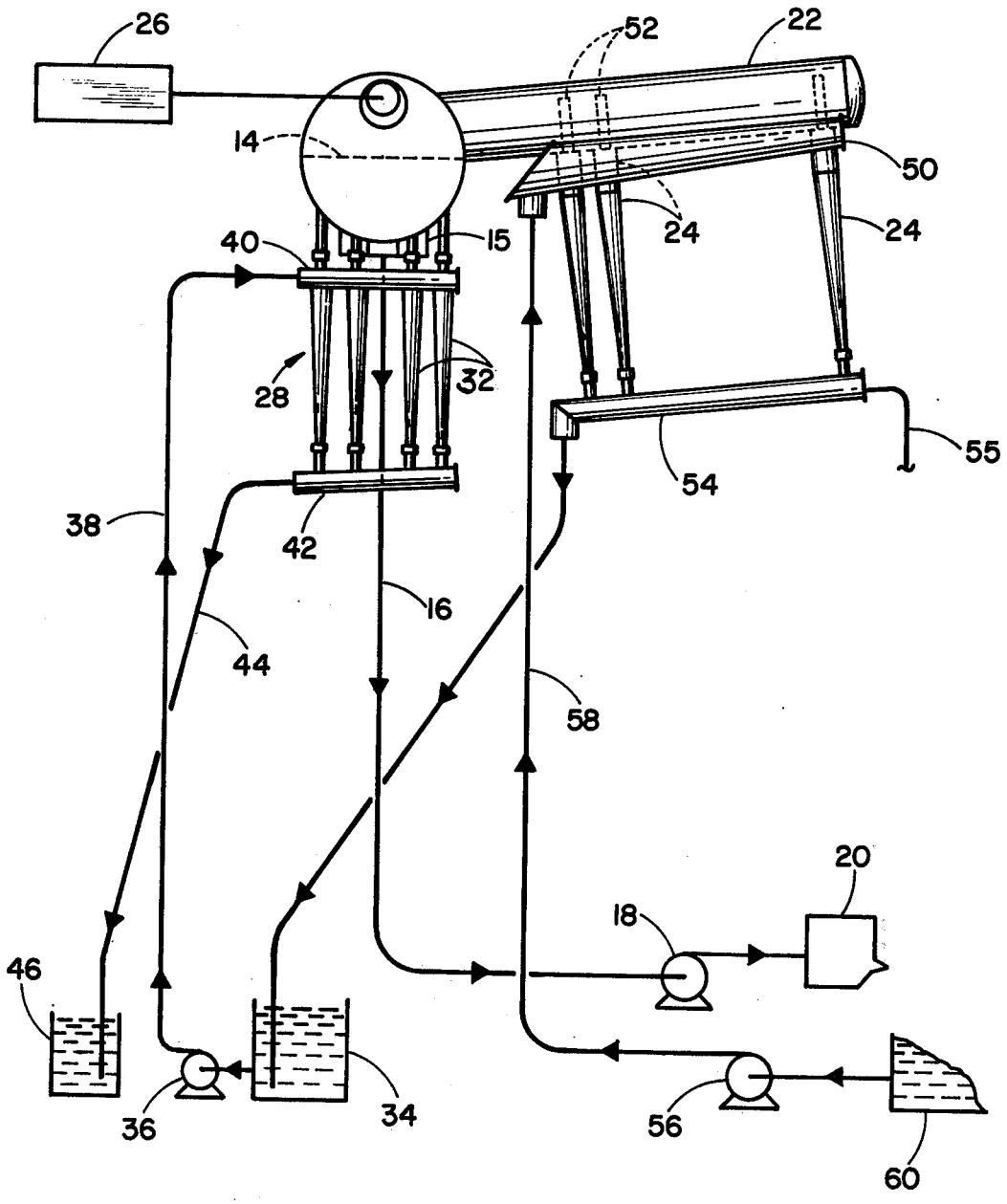
FIG. 2 is an elevational view of the apparatus shown in FIG. 1 showing the enclosed receiver into which the dirt-poor discharge from the cleaners is delivered as being in the form of an inclined wing section extending upwardly at an inclination to a central or main receiver.
Figure 3:
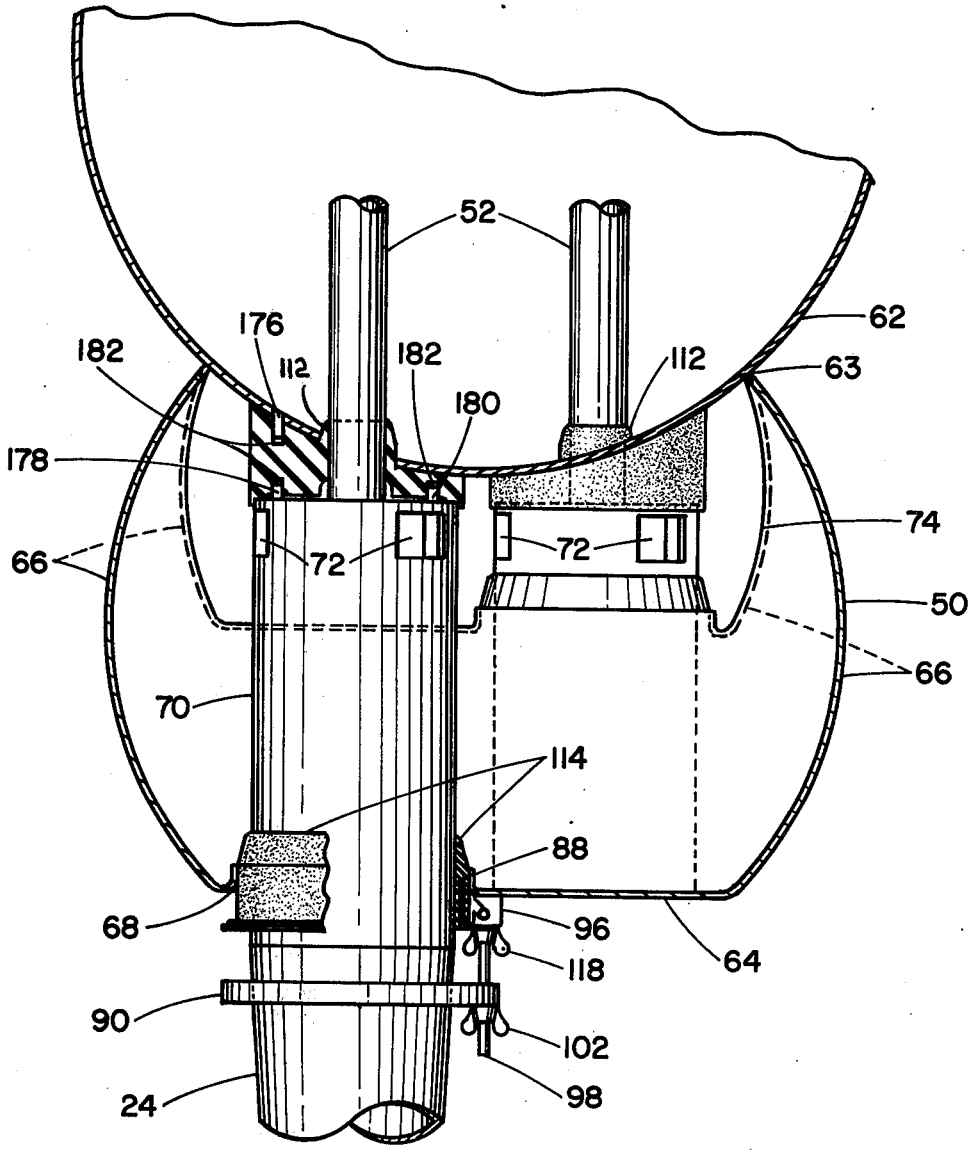
FIG. 3 is a vertical sectional view on enlarged scale of one of the wing receivers depicted in FIGS. 1 and 2 showing the manner in which the centrifugal cleaners are mounted in the feed plenum, the feed plenum being of a uniformly diminishing cross-section in the direction of the flow of suspension.

Turning now to consideration of the apparatus depicted in FIGS. 1–3, the same is described in relation to the employment of enclosed receivers into which papermaking stock in the form of an accepts portion issuing from the cleaners is collected in one or more wing receivers extending inclined upwardly from a central stock receiver. The particular cleaning operation depicted and in which the cleaners are mounted in accordance with the invention is a primary stage cleaning operation although it will be understood that the principles of the invention are applicable equally to secondary, tertiary and subsequent stage cleaning operations and the invention is not limited to utilization with a wing receiver arrangement such as shown. It could, for example, also embody a plenum mounted directly below the central receiver in the instance where cleaners discharge directly into such central receiver. With reference now to the drawings, the apparatus 10 includes an elongated central stock receiver 12 which serves for collecting cleaned deaerated stock as a pond thereof within the receiver 12, the receiver being provided with an overflow weir 14 in the manner and for the same purposes as set forth in U.S. Pat. No. 3,206,917. Stock collected in the pond is conveyed by means of receiver stock outlet 15, conduit 16 and pump unit 18 to the papermaking machine 20 in the customary manner. The enclosed wing receivers 22, the interiors of which communicate directly with central receiver 12 are of the type described in U.S. Pat. No. 3,538,680 and preferably extend in the slightly inclined orientation shown although they could in some instances be horizontally arranged. The accepts portions issuing from the first or primary cleaning stage cleaners 24 are sprayingly discharged into the zone of vacuum maintained in the respective wing enclosures 22 and a collected flow thereof courses downwardly from the wing into the central receiver 12. Suitable vacuum producing means 26 is provided for maintaining both the central and wing receivers under condition of vacuum sufficient to deaerate the cleaned accepts portions issuing from the primary cleaning stage. As is common with some systems, a secondary cleaning stage 28 is mounted under the central receiver 12 with the discharge of accepts therefrom being conveyed to a compartment 30 at the overflow side of the weir 14 in the central receiver and subsequently processed as taught in the aforementioned patents. The stock suspension supplied to the secondary cleaners 32 is pumped from a primary cleaner rejects seal box 34 to which dilution is added, through pump unit 36 and conduit 38 to manifold 40 connected with the respective cleaners 32, the rejects portion from the primary cleaning stage as will be described later being conveyed from such primary stage to said seal box 34. The rejects portion from the secondary cleaning operation is collected in manifold 42 and conveyed through conduit 44 to a rejects seal box 46, where dilution water is added and from whence it is conveyed to a third stage or tertiary cleaning operation etc.

With reference now to the more particular aspects of the present invention, the primary cleaning stage can include any number of primary wing units 22 although only two are depicted. Each primary wing is fitted at the underside thereof with an elongated plenum 50 and mounted within the plenum 50 are a plurality of centrifugal cleaners 24, the cleaners extending in longitudinal array along the plenum and each having an accepts pipe 52 connected thereto and extending upwardly into a wing receiver 22. The lower or rejects end of the respective cleaners are connected to a rejects manifold 54 from which the rejects are conveyed to the seal box 34. Suspension is supplied to the feed plenum 50 by means of pump unit 56 through conduit 58 with the source of such suspension along with fresh stock being provided in known manner from a suitable source such as a wire pit 60 under the paper machine. As will be noted, the respective cleaners 24 in the primary stage are mounted in substantially vertical orientation and each is arranged parallel with the other such disposition being the natural attitude for use of this type of cleaner in which use of the force of gravity is used to assist rejects discharge. As used herein "substantially vertical" means an orientation in which the axis of the cleaner is at substantially 75° to 95° relative to a horizontal plane. In the particular embodiment shown, the cleaner axes are disposed substantially perpendicular to the longitudinal axes of the wing receivers 22. The feed plenum 50 as can be seen from FIG. 2 is provided with a cross-section which diminishes in size at a uniform rate from the left end or point at which the paper-making suspension is introduced into the plenum and towards the right or other end, that is in the direction of flow of the suspension in the plenum. If suspension introduction were made at mid-length of the plenum, then the same of course would diminish in cross-section from such point in the direction of both ends. FIG. 3 in particular depicts in cross-sectional view the manner in which the respective cleaners (shown as being arranged in two longitudinal rows thereof) are mounted in the plenum and also the feature of the diminishing cross-sectional area of the plenum in the direction of flow which in this instance is away from the viewer.

With further reference to FIG. 3, the wing receiver 22 lower section or underside 62 serves in this particular embodiment as part of the plenum defining enclosure structure. Thus the plenum 50 is provided with a lower wall part 64 and a pair of side walls 66 which merge upwardly into contact with the underside 62 of the wing receiver and which are connected thereto in known manner, the connection being such as to provide an air-excluding joint where the plenum merges with and is connected to the receiver as at 63. The lower wall part 64 of the plenum is provided with openings 68 (see also FIGS. 5 and 6) through which the upper body portions 70 of the cleaners 24 are received, the arrangement being such that the inlets 72 in the side wall structure of the cleaner are disposed within the plenum and submerged in the suspension flow therein. Thus it will be noted with respect to the cleaners depicted, and further with respect to the diminishing cross-sectional area of the plenum particularly as shown at 74, the inlets are arranged at the same elevation and are in direct communication with the plenum so as to be submerged in the suspension flow therein. It is desirable to provide a diminishing cross-sectional area of the plenum as the plenum regions become more remote from the point of introduction of stock so as to maintain a constant velocity in the suspension flow since all of the cleaners in the stage are designed to operate most efficiently under the same flow velocity conditions.

Figure 4:
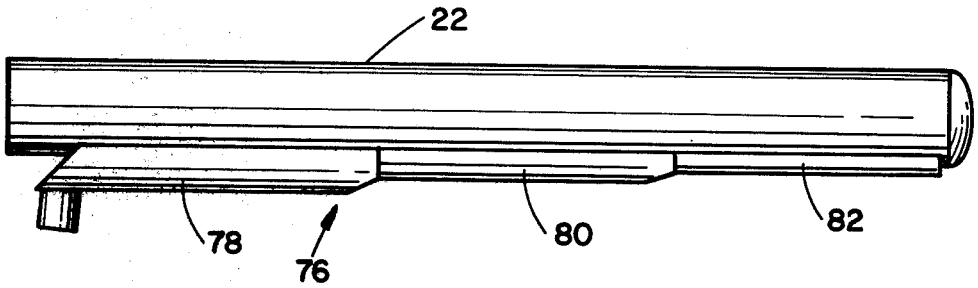
FIG. 4 is a side elevational view of another form of enclosed receiver in which the feed plenum cross-sectional area diminishes in stepped reduction along successive lengths of the plenum.
Figure 4A:
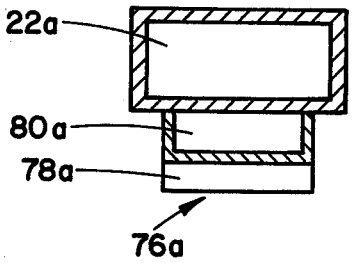
FIG. 4*a* is a vertical sectional view of a further feed plenum and receiver arrangement wherein each is of rectangular cross-section.

An alternative form of plenum-receiver arrangement 76 is depicted in FIG. 4 wherein it can be seen that the plenum diminishes in cross-sectional area in a stepped reduction along successive lengths 78, 80, 82 of the feed plenum from one end towards the other. FIG. **4*a* depicts an arrangement 76*a* wherein the receiver 22*a* is of rectangular section and the plenum sections 78*a*, 80*a*** are of like configuration. The shapes of receiver and plenum arrangements can be varied and by way of example include, circular, elliptical, square and rectangular sectional receivers and/or like configured plenums.

Figure 7:
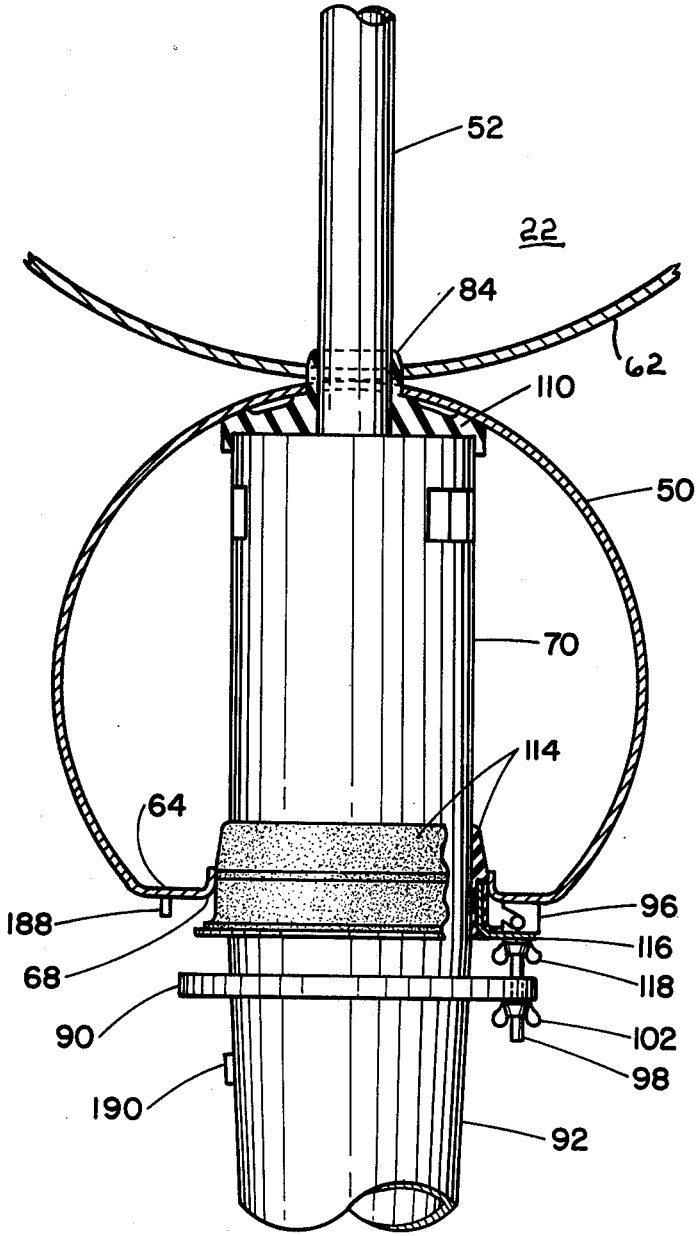
FIG. 7 is a vertical section view on enlarged scale of a further embodiment of plenum in which the plenum is a separate enclosed structure supported at the underside of a wing receiver, and showing further the removable mounting of a cleaner unit therein, there further being shown a bottom seal disposed at the opening in the lower wall of the plenum and an upper seal on top of the cleaner body which seals provide air-excluding joints where the cleaner enters the plenum and where the pipe connected to the cleaner passes from the plenum into the receiver.

FIG. 7 shows in cross-section an arrangement wherein the enclosed receiver wall structure 62 does not form part of the plenum enclosure, the plenum enclosure in this instance being constituted as a separate structure 50 below the receiver and being supported in such position by means not shown. However, it will be seen that the plenum is a fully encircling member being provided only with openings 68 at the bottom through which the cleaners are received in the plenum and also having an opening 84 at the top through which the accepts pipe 52 passes from the cleaner into the receiver 22.

Figure 6:
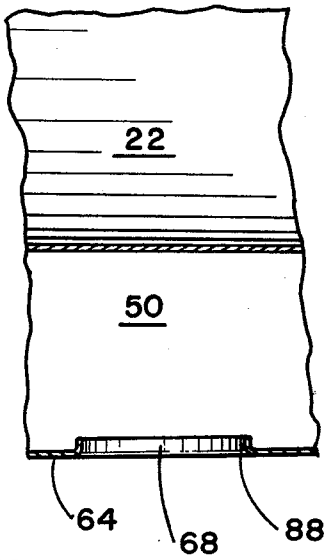
FIG. 6 is a side view of FIG. 5.
Figure 5:
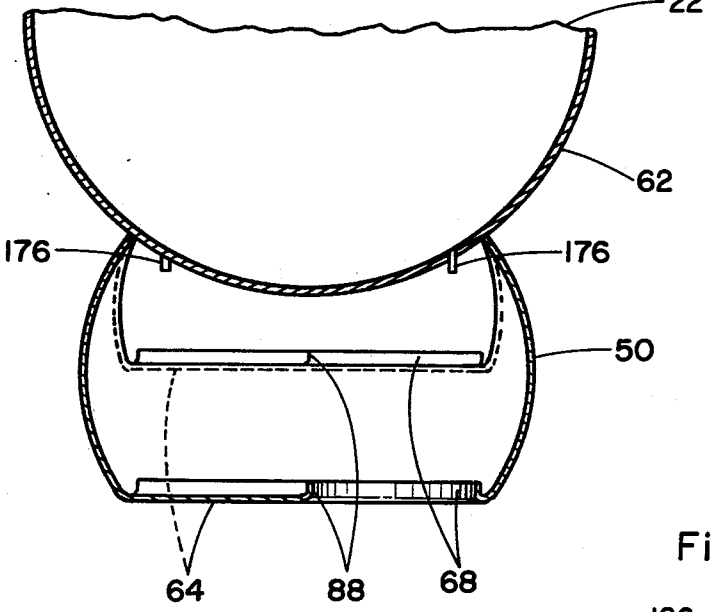
FIG. 5 is a fragmentary vertical sectional view through the receiver and plenum showing the manner in which the lower wall part of the plenum is provided with openings for the reception of the cleaner upper body portions.

FIGS. 5 and 6 show the plenum lower wall part opening formations, and the plenum lower wall part 64 from which it will be noted that the openings 68 are surrounded by an upstanding flange 88 which serves to effect sealing of the joints at the points of entry of the cleaners to the plenum in the manner as will be described later.

Figure 8:
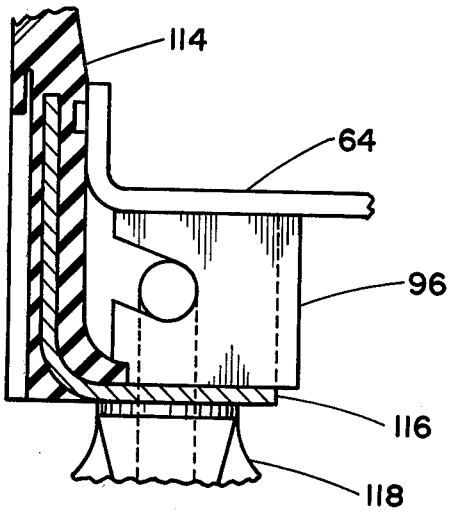
FIG. 8 is an enlarged fragmentary view showing the manner in which the bottom seal is mounted at the lower wall opening.
Figure 9:
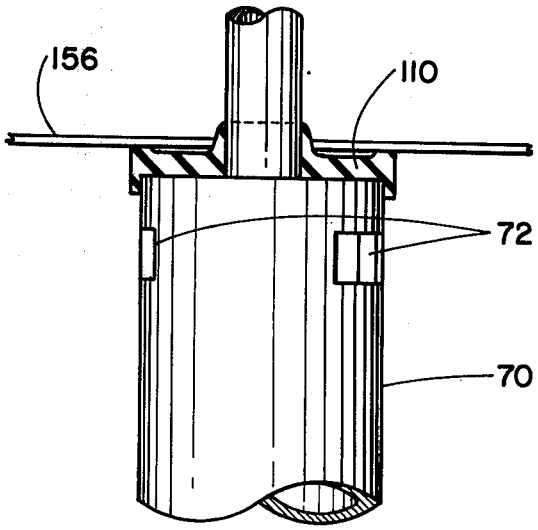
FIG. 9 is a view similar to FIG. 7 showing the manner in which the cleaner is received in a plenum in which the underside of the receiver itself serves to define the structure of the plenum.

With reference again to FIG. 3 and to FIGS. 7 and 8, it will be noted that the respective cleaners 24 are removably mounted in the plenum 50 by means as will be described next.

Figure 14:
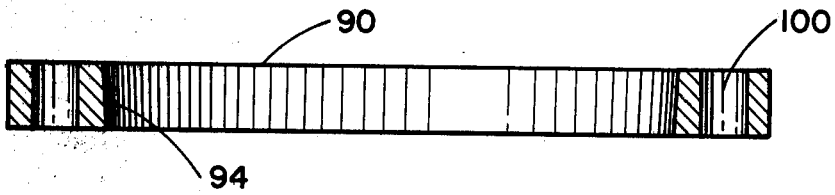
FIG. 14 is an elevational view of one form of mounting ring in which the inner surface thereof is tapered in correspondence to the tapered outer surface of the cleaner body with which it is used.
Figure 13:
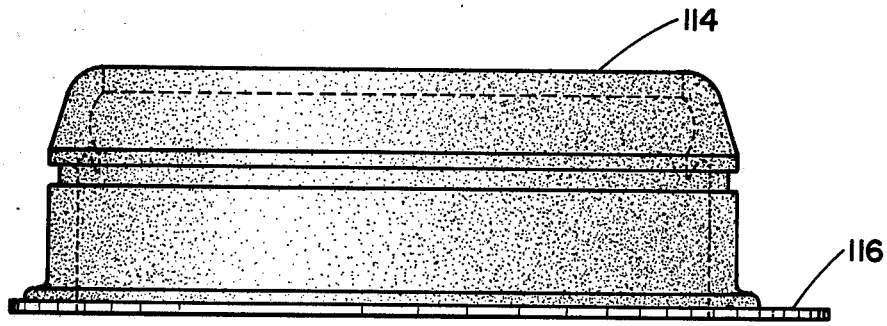
FIG. 13 is an elevational view of the lower seal used in conjunction with the cleaner mounting shown in FIGS. 7, 9 and 10.
Figure 12:
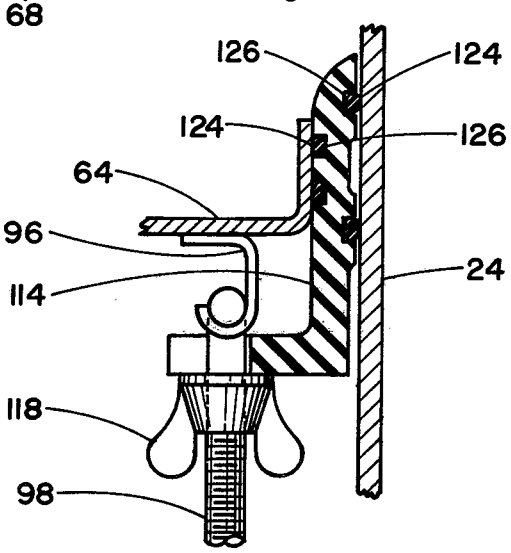
FIG. 12 is a fragmentary sectional view showing an alternate form of effecting an air-excluding joint at the lower seal wherein o-rings are used for such purpose.
Figure 11:
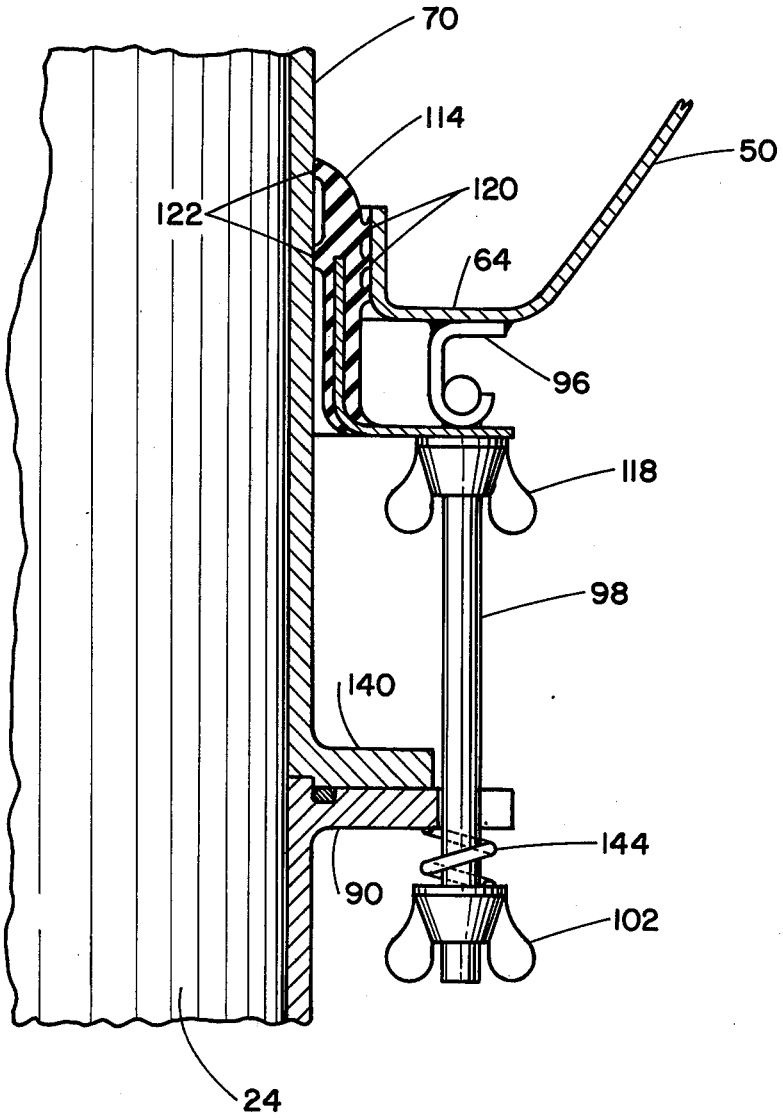
FIG. 11 is a fragmentary vertical sectional view on enlarged scale showing the manner in which the mounting of the cleaner in the plenum is effected and wherein the support ring is formed as part of the cleaner body and is employed for urging the cleaner upwardly in the plenum, the lower seal at the opening in the lower wall being in the form of a labyrinth device.

A support ring 90 encircles the cleaner lower body portion 92 which in this instance is of tapered surface configuration and the support ring is likewise provided with an inner tapered surface 94 (FIG. 14). A bracket 96 is mounted at the underside of the lower wall part of the plenum adjacent the opening 68 and depending from the brackets is a bolt member 98, the bolt member desirably being a T-bolt which is pivoted in the bracket. The bolt member passes downwardly through an opening 100 provided in the support ring and a wing nut 102 is threaded on the bolt below the support ring. By taking up on the wing bolt, the support ring which loosely encircles the cleaner lower body portion 92 is taken up into sliding tapered surface contact with the cleaner. Continued tightening of the wing bolt will result in upward urging of the cleaner upper body portion 70 in the plenum. To provide a seal at the top of the cleaner 24, a top seal member 110 of flexible material is received on top of the cleaner and is provided at its upper surface with a generally complimental configuration with that of the undersurface of the receiver. The top seal 110 also includes a portion 112 which extends upwardly through the opening in the receiver which admits the accepts pipe 52 and in this manner there is effected an air-excluding joint at such location. At the bottom of the upper body portion 70, a flexible seal member 114 encircles the cleaner the extends both above and below the opening 68 in the plenum lower wall part 64 for a certain distance. The seal 114 which is shown more particularly in FIG. 13 includes a lower flange portion 116 through which the bolt member 98 extends and a second wing nut 118 is disposed below the flange 116. By taking up on this wing nut, the seal is fixed and located by bracket 96 at the opening of the plenum lower wall part. For effecting an air-excluding joint at such locations, suitable sealing means as depicted in FIGS. 11 and 12 can be employed. Thus the lower seal member 114 can include a labyrinth arrangement such as shown at 120 and 122 or alternatively, o-rings 124 can be received in grooves 126 formed in the surfaces of the lower seal sleeve in the manner shown in FIG. 12. It will be seen then that when installing the cleaners or if necessary when removing same, such task can be effectively and simply done with a minimum of disassembling of structure at the plenum.

Figure 10:
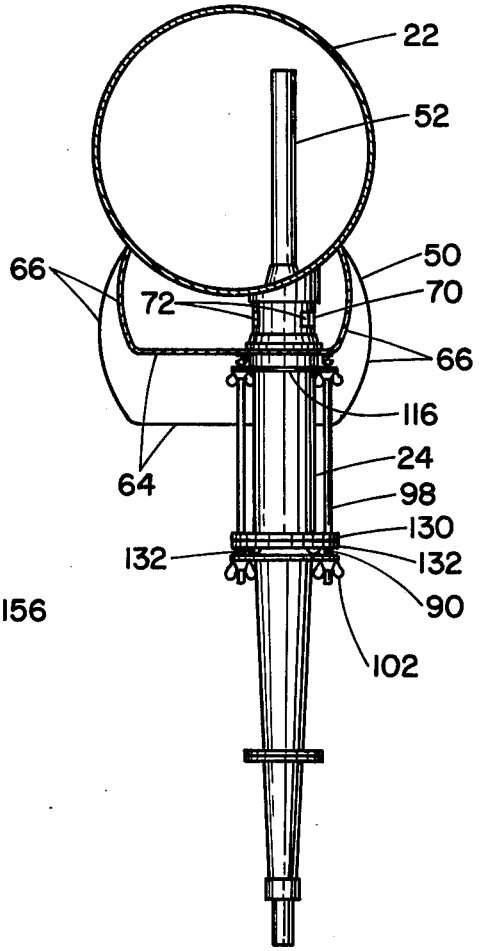
FIG. 10 is a vertical sectional view showing a further embodiment of mounting of a cleaner in the plenum.

FIGS. 10 and 11 show alternative means of mounting the cleaners 24 to the plenum. Thus, in FIG. 10, the support rings 90 instead of conforming with a tapered shape on the cleaner body, is disposed below a pair of flanges 130 formed on the upper body part 70 of the cleaner and the lower of which include a pair of depending projections 132. The support ring 90 is disposed below these projections and by taking up on the wing nuts 102, the cleaner is forced upwardly in the plenum.

FIG. 11 shows a form of mounting which is employed on cleaners where a flange is formed on the cleaner body as at 140 and the support ring 90 is also formed as a flange on the cleaner body. By taking up on the wing nut 102, the flange 90 and hence the entire cleaning assembly is urged upwardly in the plenum. Since cleaners of certain materials are known to expand longitudinally during the operation of the same, it is desirable in some instances to not have a rigid mounting cleaner that would not compensate for such expansion. FIG. 11 shows one manner for providing for such contingency. The compression spring 144 is received below flange 90 and the wing nut 102 is turned against the spring. The spring will compress to a certain degree to effect proper initial mounting placement of the cleaner in the plenum. However, as the cleaner expands, the spring will be compressed further to allow for the expansion movement of the cleaner body.

Figure 15:
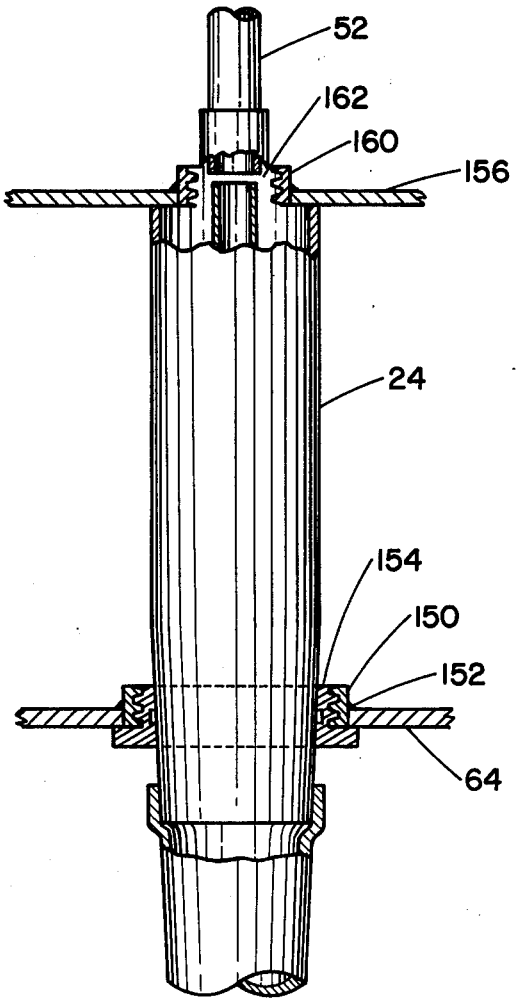
FIG. 15 shows a further form of mounting for removably mounting the cleaner body in the plenum in which a threaded ring at the plenum upper wall opening is engaged by a threaded collar structure on the cleaner body to suspend the cleaner in the plenum chamber.

Still another manner of mounting the cleaner in the plenum is depicted in FIG. 15 which shows the use of a threaded ring 150 which is fixedly secured as by welding 152 at the opening in the lower wall part 64 of the plenum. A companionly threaded collar 154 is received around the cleaner body and by rotating the collar in ring 150, upward force is applied to the plenum lower wall 64 upwardly toward the top wall 156 of the plenum, the inner surface of the collar being complimentally configured with the outer surface of the cleaner body in this instance the two being tapered. A similar fashion of connection can be effected at the top wall of the plenum for suspending or hanging same in the plenum where it will be noted a threaded ring 160 is fixed to the plenum top wall and a threaded crown or headpiece 162 on the cleaner is threaded into such ring to securely fix the cleaner at that location.

Figure 16:
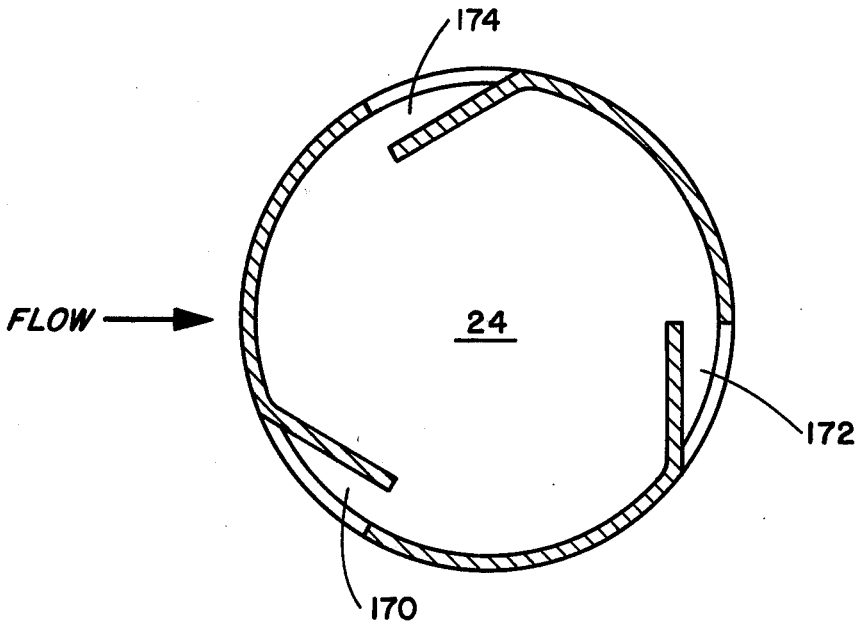
FIG. 16 is a horizontal cross-sectional view depicting a cleaner having plural inlets, the inlets being oriented in a predetermined disposition relative to the direction of flow of suspension in the plenum.

The invention also provides means for fixing the disposition of the cleaner inlets relative to the direction of suspension flow in the plenum particularly in the instance where plural inlets are provided in the cleaner. Thus as seen in FIG. 16, a cleaner may have three inlets 170, 172, 174 arranged as shown relative to the direction of stock flow, one opening 172 being positioned at the rear of the cleaner body relative to suspension flow to insure that no suspension flow stagnation occurs at such location. In order to provide a particular orientation of these inlets which are circularly spaced one from the other, locator means as shown for example in FIG. 3 can be employed. Thus a projection 176 is formed at the undersurface of the receiver 22 and projections 178, 180 are also provided on the top of the cleaner. Recesses 182 are formed in the seal unit 110 and since the seal unit conforms to the surface configuration of the underside of the receiver, it can only be received in proper relative positioning when the projection 176 is disposed within its companion recess 182. When the cleaner 24 is thereafter inserted in the plenum and forced upwardly, it need only be rotated until the projections 178, 180 enter the recesses 182 and in such manner the proper orientation of the inlets is effected.

FIG. 7 shows an alternative mode of orienting the inlets of the cleaner relative to the direction of flow in the plenum. In this instance, the orientation means are disposed external of the plenum and include a telltale indicia 190 mounted on the cleaner body which can be positioned circularly relatively of a companion telltale 188 formed on the lower wall part of the plenum. In such manner, from an external location it is possible to effect a particular positioning of the inlets to the cleaner relative to the direction of flow. As used herein "indicia" includes both structure such as a projection or a marking in or on structures such as a groove, decalomania etc.

Figure 17:
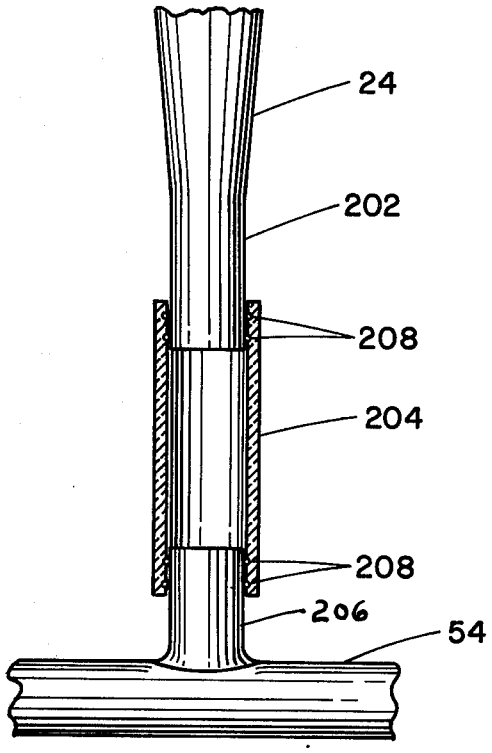
FIG. 17 is a vertical elevational view showing the manner in which the rejects ends of the cleaners are connected to a rejects chamber.
Figure 19:
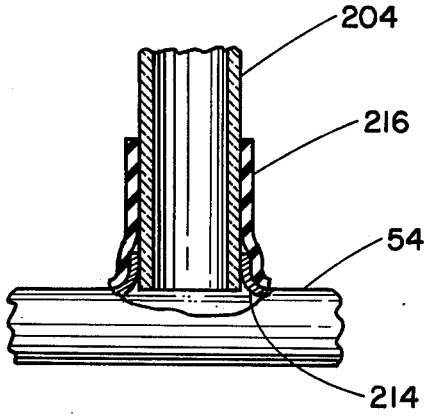
FIG. 19 is a view similar to FIG. 18 except that in lieu of the grommet structure used for enclosing the joint at the rejects chamber, a thin membrane is used.
Figure 18:
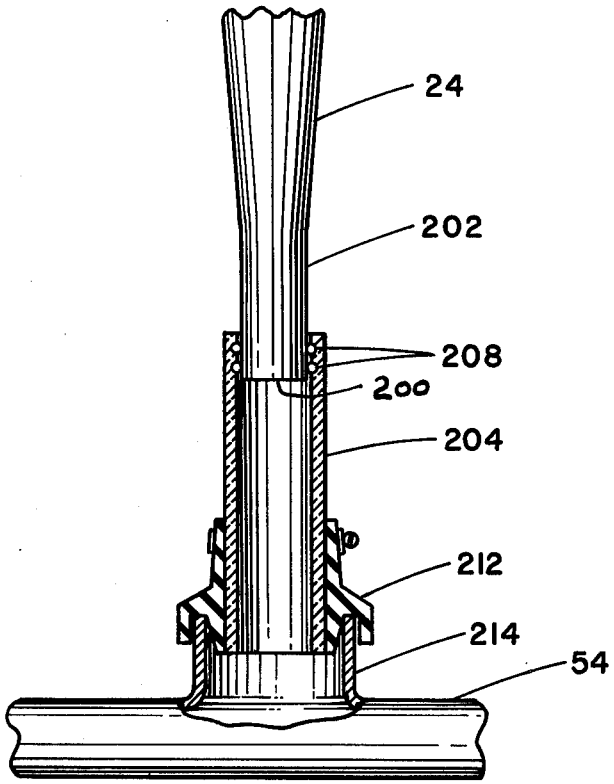
FIG. 18 is an alternative form of mounting for connecting the rejects end to the rejects chamber.

With reference now to FIGS. 17–19, there are shown various manners of connecting the rejects outlet 200 of the cleaners 24 to the rejects chamber 54 which by means of line 55 can be connected to a source of vacuum. As shown in FIG. 17, the lower straight section 202 of the cleaner rejects end is connected to an upstanding tube 204 formed on the rejects chamber by means of a sight glass 204 formed of lucite, pyrex or other suitable transparent material. Disposed within the tube 204 and intervening the outer surface of the lower end section 202 of the cleaner and the connector tube 206 on the chamber are suitable sealing means such as o-rings 208 which provide an air-excluding joint connection of the cleaner at the rejects end to the chamber. At the same time if it is desired to remove the cleaner from the cleaning stage for any purpose, it is only required that the sight glass tube 204 be slid upwardly until the lower part thereof clears the tube 206. The cleaner then can be removed without interference from the rejects chamber.

FIG. 18 shows another manner of forming an air-excluding joint at the rejects chamber in which case, a grommet 212 of soft material is received over the lower end of the sight glass 204 and also adjacent surfaces 214 on the rejects chamber. Due to the fact that the rejects chamber is under a condition of vacuum, the grommet will collapse during operation of the cleaning stage to effect a tight seal between the two. FIG. 19 shows an alternative form of sealing means which in this instance is provided as a thin flexible membrane 216 of tubular configuration.

Figure 20:
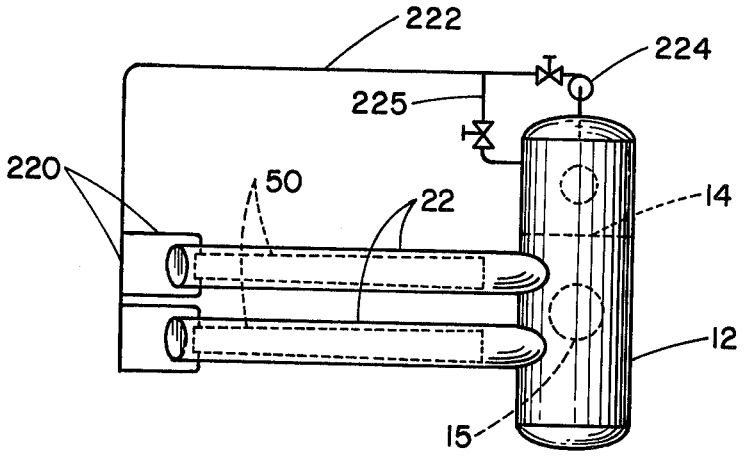
FIG. 20 is a top plan view depicting a bleed or purge system which is used for bleeding flow suspension from the plenum at locations remote from the point of introduction of suspension thereto with such bleed flow being supplied to a subsequent point of use as a centrifugal cleaner.

A further feature of the invention is shown in FIG. 20 wherein the various plenums 50 at locations remote from the point at which suspension is introduced into the plenum are connected by means of conduits 220 and 222 to a further point of use which in this instance is in the form of a centrifugal cleaner 224 or other point of use, e.g., connection by means of line 225 to overflow compartment 30. Thus a portion of the suspension delivered to the plenum is used to purge the plenum of any air or solids as may be present at the remote location to thereby prevent undesirable build-up of of either air and/or solids within the plenum. The bleed or purge lines 220, 222 also can be employed for effecting or adjusting velocity control of the flow within the plenum.

From the foregoing description it will be understood that the present invention provides highly advantageous improvements in the manner in which centrifugal cleaners are mounted in a cleaning stage in a papermaking system. Such improvements provide for significant savings both from a standpoint of initial installation costs as well as system operation costs by eliminating unnecessary fittings, piping and the like and also contribute to the reduction in the amount of power required to operate the cleaning stage.

As used herein and in reference to description of the cleaner body shape, "generally cylindrical" will be understood as being inclusive of cleaners having a conical surfaced body at the top portion thereof as well as at the lower portion.

As used herein, "Air Excluding Joint" will be understood as meaning a joint which is impervious to fluid flow therethrough.

What is claimed is:

1. In apparatus for cleaning and deaerating a suspension of papermaking stock which includes a cleaning stage comprising centrifugal cleaners for separating the suspension into dirt-rich and dirt-poor fractions, each centrifugal cleaner having an elongated body with a generally smooth outer surfaced upper body part, outlets at the opposite ends of said body through which dirt-rich and dirt-poor fractions can discharge therefrom, and at least one inlet in the side of said upper body part through which suspension is introduced into said cleaner in a tangential inflow course, a feed plenum, means for supplying a flow of suspension to the interior of said plenum, the cleaners in said stage being readily removably mounted in said feed plenum with the inlets to each disposed within said plenum and submerged in said suspension flow, said cleaners further being oriented parallel one with the others and with the major axis of each in substantially vertical disposition with the dirt-rich and dirt-poor outlets located at the respective lower and upper ends of said body, said supply means supplying suspension to said feed plenum with sufficient force to introduce it into said cleaners and separate it therein into dirt-rich and dirt-poor fractions and further to discharge said fractions from said cleaners, an enclosed elongated, generally horizontally disposed receiver for receiving the dirt-poor fraction from said cleaners, and feed plenum being elongated and disposed at the underside of said receiver, and including a lower wall part and an upper wall part extending to the underside of said receiver, the lower wall part of said plenum being provided with openings for receiving the upper body parts of said cleaners, there being mounting means carred on said lower wall adjacent each opening and engageable with said upper body parts for removably mounting said cleaners on said plenum, and including a seal member encircling the upper body part of each cleaner where it passes through the opening in the plenum lower wall part and extending a distance above and below said lower wall part, a support ring carried on said cleaner body a distance below said opening, and means for applying lifting force to said support ring for urging said cleaner upwardly in said feed plenum, the ring urging means including a bolt member supported from said plenum lower wall part and passing through said support ring, and a nut member carried on said bolt member below said support ring, there further being means in said mounting means for compensating for longitudinal expansion of radial cleaner body, evacuating means connected to the receiver for maintaining the interior thereof under a condition of vacuum, each cleaner having pipe means connecting the dirt-poor discharge outlet of said cleaner with said receiver, said pipe means terminating in an open end within said receiver above the level of any dirt-poor suspension collecting therein, and a chamber connected with the dirt-rich discharge outlet of each cleaner for collecting dirt-rich suspension discharging from said cleaners, there being means connected with said chamber for maintaining the interior thereof under a condition of vacuum.

2. The apparatus of claim 1 wherein said compensating means comprises a compression spring carried on said bolt member and disposed intermediate said support ring and said nut member.

3. The apparatus of claim 1 further comprising conduit means connected with said plenum at a location remote from the point of introduction of suspension to said plenum for purging from said plenum with suspension flow therefrom of any air and solids which are present in said plenum at said location, said conduit means discharging to a point of use.

4. The apparatus of claim 3 in which said point of use is a suspension cleaning device.

5. The apparatus of claim 3 in which said point of use is a zone of vacuum.

6. In apparatus for cleaning and deaerating a suspension of papermaking stock which includes:

a cleaning stage comprising centrifugal cleaners for separating the suspension into dirt-rich and dirt-poor fractions, each centrifugal cleaner having an elongated body with a generally smooth outer surfaced upper body part, outlets at the opposite ends of said body through which dirt-rich and dirt-poor fractions can discharge therefrom, and at least one inlet in the side of said upper body part through which suspension is introduced into said cleaner in a tangential inflow course, a feed plenum, means for supplying a flow of suspension to the interior of said plenum, the cleaners in said stage being readily removably mounted in said feed plenum with the inlets to each disposed within said plenum and submerged in said suspension flow, said cleaners further being oriented parallel one with the others and with the major axis of each in substantially vertical disposition with the dirt-rich and dirt-poor outlets located at the respective lower and upper ends of said body, said supply means supplying suspension to said feed plenum with sufficient force to introduce it into said cleaners and separate it therein into dirt-rich and dirt-poor fractions and further to discharge said fractions from said cleaners, an enclosed elongated, generally horizontally disposed receiver for receiving the dirt-poor fraction from said cleaners, said feed plenum being elongated and disposed at the underside of said receiver, and including a lower wall part of an upper wall part extending to the underside of said receiver, the lower wall part of said plenum being provided with openings for receiving the upper body parts of said cleaners, there being mounting means carried on said lower wall adjacent each opening and engageable with said upper body parts for removably mounting said cleaners on said plenum, and including a seal member encircling the upper body part of each cleaner where it passes through the opening in the plenum lower wall part and extending a distance above and below said lower wall part, a support ring carried on said cleaner body a distance below said opening, and means for applying lifting force to said support ring for urging said cleaner upwardly in said feed plenum, the ring urging means including a bolt member supported from said plenum lower wall part and passing through said support ring, and a nut member carried on said bolt member below said support ring, and in which said seal member is a flexible sleeve, said sleeve having an annular flange at the lower end thereof, there being bracket means fixed to said plenum lower wall part adjacent said opening, said bolt member being pivoted in said bracket, and a second nut member carried on said bolt member and intervening said bracket and said support ring, said second nut member being disposed below and in supporting engagement with said sleeve annular flange, evacuating means connected to the receiver for maintaining the interior thereof under a condition of vacuum, each cleaner having pipe means connecting the dirt-poor discharge outlet of said cleaner with said receiver, said pipe means terminating in an open end within said receiver above the level of any dirt-poor suspension collecting therein, and a chamber connected with the dirt-rich discharge outlet of each cleaner for collecting dirt-rich suspension discharging from said cleaners, there being means connected with said chamber for maintaining the interior thereof under a condition of vacuum.

7. The apparatus of claim 6 in which the cross-sectional area of said feed plenum diminishes from the point of introduction of suspension into said feed plenum in the direction of the flow therein to maintain the flow velocity of said suspension substantially constant at all points within said feed plenum.

8. The apparatus of claim 6 in which said enclosed receiver is a deaerating chamber extending outwardly and upwardly inclinedly from a central enclosed stock receiver, the interior of said deaerating chamber being in communication with the interior of said stock receiver.

9. The apparatus of claim 6 in which said support ring is a flange on the cleaner body.

10. The apparatus of claim 6 in which said cleaner has a tapered lower body portion, said support ring being an annular member loosely received on said lower body portion and having a tapered inner ring surface conforming with the taper on said cleaner lower body portion.

11. The apparatus of claim 6 in which said cleaner body is provided with a flange thereon, said support ring being loosely received on said cleaner body below said flange.

12. The apparatus of claim 6 in which said plenum lower wall part is provided with an upstanding flange encircling each opening in which a cleaner is received, said seal member intervening said flange and said cleaner upper body part.

13. The apparatus of claim 12 in which said sleeve embodies means for maintaining an air excluding joint where said cleaner upper body portion passes through said lower wall part.

14. The apparatus of claim 13 in which said air excluding joint means is a labyrinth structure in said sleeve engageable with said upstanding flange and said cleaner upper body portion.

15. The apparatus of claim 13 in which said air excluding joint means are o-ring members carried in grooves in said sleeve and engageable with said upstanding flange and said cleaner upper body portion.

16. The apparatus of claim 6 in which said feed plenum is a separate enclosed structure supported at the underside of said receiver, the pipe means of each cleaner passing through an opening at the top of said plenum and an opening in the underside of said receiver, there being a seal unit on the top of said cleaner body and extending through said plenum top opening at said receiver underside opening for maintaining an air excluding joint where said pipe means passes from said plenum into said receiver, said mounting means urging the top of said cleaner against said seal unit and said seal unit against the top of said plenum.

17. The apparatus of claim 16 in which said seal unit has a surface which conforms substantially with the undersurface of the top of said plenum.

18. The apparatus of claim 6 in which the upper wall part of said plenum comprises side walls which are connected to the underside of said receiver whereby said receiver underside defines a part of the plenum enclosure structure, the pipe means of each cleaner passing through an opening in the underside of said receiver, there being a seal unit on the top of said cleaner body and extending through said cleaner underside opening for maintaining an air excluding joint where said pipe means passes from said plenum into said receiver, said mounting means urging the top of said cleaner against said seal unit and said seal unit against the underside of said receiver.

19. The apparatus of claim 18 in which said seal unit has a surface which conforms substantially with the surface of the underside of said receiver.

20. In apparatus for cleaning and deaerating a suspension of papermaking stock which includes:

a cleaning stage comprising centrifugal cleaners for separating the suspension into dirt-rich and dirt-poor fractions, each centrifugal cleaner having an elongated body with a generally smooth outer surfaced upper body part, outlets at the opposite ends of said body through which dirt-rich and dirt-poor fractions can discharge therefrom, and at least one inlet in the side of said upper body part through which suspension is introduced into said cleaner in a tangential inflow course, a feed plenum, means for supplying a flow of suspension to the interior of said plenum, the cleaners in said stage being readily removably mounted in said feed plenum with the inlets to each disposed within said plenum and submerged in said suspension flow, said cleaners further being oriented parallel one with the others and with the major axis of each in substantially vertical disposition with the dirt-rich and dirt-poor outlets located at the respective lower and upper ends of said body, said supply means supplying suspension to said feed plenum with sufficient force to introduce it into said cleaners and separate it therein into dirt-rich and dirt-poor fractions and further to discharge said fractions from said cleaners, an enclosed receiver for receiving the dirt-poor fraction from said cleaners, said feed plenum being disposed at the underside of said receiver, evacuating means connected to the receiver for maintaining the interior thereof under a condition of vacuum, each cleaner having pipe means connecting the dirt-poor discharge outlet of said cleaner with said receiver, said pipe means terminating in an open end within said receiver above the level of any dirt-poor suspension collecting therein, and a chamber connected with the dirt-rich discharge outlet of each cleaner for collecting dirt-rich suspension discharging from said cleaners, there being means connected with said chamber for maintaining the interior thereof under a condition of vacuum, the dirt-rich discharge outlet of each cleaner and the chamber to which it is connected being intervened by a tubular sight glass connected with said outlet and said chamber in air-excluding relationship, the air-excluding connection of said sight glass with said chamber comprising a flexible member encircling said sight glass where it enters said chamber and adjacent surfaces of said chamber, said member collapsing against said sight glass and said adjacent surfaces under the influence of reduced pressure in said chamber thereby to effect an air-excluding seal therebetween.

* * * * *

UNITED STATES PATENT AND TRADEMARK OFFICE

CERTIFICATE OF CORRECTION

PATENT NO. : 4,146,469

DATED : March 27, 1979

INVENTOR(S) : Robert G. Kaiser and Jack J.J. Jacobsson

It is certified that error appears in the above-identified patent and that said Letters Patent are hereby corrected as shown below:

At Col. 6, line 2, "use as a" should read --use such as a--.

At Col. 12, line 3 (Claim 1), "and feed plenum" should read --said feed plenum--.

At Col. 12, line 10 (Claim 1), "means carred on" should read --means carried on--.

At Col. 13, line 23 (Claim 6) "of an upper wall" should read --and an upper wall--.

Signed and Sealed this

*Tenth* Day of *July 1979*

[SEAL]

*Attest:*

*Attesting Officer*

LUTRELLE F. PARKER

*Acting Commissioner of Patents and Trademarks*